US010752389B2

(12) United States Patent
Nomura et al.

(10) Patent No.: US 10,752,389 B2
(45) Date of Patent: Aug. 25, 2020

(54) ROD-SHAPED BODY BINDING DEVICE, BOUND BODY OF ROD-SHAPED BODY, AND ROD-SHAPED BODY BINDING METHOD

(71) Applicant: NISSHIN SEIFUN GROUP INC., Tokyo (JP)

(72) Inventors: Mitsuo Nomura, Fujimino (JP); Keisuke Fujii, Kawagoe (JP)

(73) Assignee: NISSHIN SEIFUN GROUP INC., Tokyo (JP)

( * ) Notice: Subject to any disclaimer, the term of this patent is extended or adjusted under 35 U.S.C. 154(b) by 687 days.

(21) Appl. No.: 14/785,423

(22) PCT Filed: Apr. 2, 2014

(86) PCT No.: PCT/JP2014/059719
§ 371 (c)(1),
(2) Date: Oct. 19, 2015

(87) PCT Pub. No.: WO2014/192409
PCT Pub. Date: Dec. 4, 2014

(65) Prior Publication Data

US 2016/0075456 A1 Mar. 17, 2016

(30) Foreign Application Priority Data

May 29, 2013 (JP) ..... 2013-112750

(51) Int. Cl.
*B65B 13/22* (2006.01)
*B65B 27/10* (2006.01)
(Continued)

(52) U.S. Cl.
CPC ..... *B65B 13/22* (2013.01); *B65B 19/34* (2013.01); *B65B 27/10* (2013.01); *B65B 57/04* (2013.01); *B65D 85/22* (2013.01)

(58) Field of Classification Search
CPC ..... B65D 85/22; B65B 13/22; B65B 13/32; B65B 57/04; B65B 19/34; B65B 27/105
(Continued)

(56) References Cited

U.S. PATENT DOCUMENTS 2,681,184 A * 6/1954 Thomas ..... B65B 13/22 242/147 R
3,051,412 A * 8/1962 Mulvey ..... B65B 13/22 242/129.2
(Continued)

FOREIGN PATENT DOCUMENTS

CN 201506475 U 6/2010
DE 2060842 A1 6/1971
(Continued)

OTHER PUBLICATIONS

Machine Translation of JP 2009035307, Translated May 5, 2018, 15 Pages.*
(Continued)

*Primary Examiner* — Gregory D Swiatocha
(74) *Attorney, Agent, or Firm* — Oliff PLC

(57) ABSTRACT

A rod-shaped body binding device includes a binding unit configured to bind a rod-shaped body by wrapping one end section of a binding tape around the rod-shaped body, a stopper configured to stop supply of the binding tape when the rod-shaped body is bound using the binding tape, and a tension regulation unit configured to continuously apply a predetermined tension to the binding tape between the stopper and the binding unit during the period from the beginning to the end of binding of the rod-shaped body by the binding unit.

10 Claims, 7 Drawing Sheets

(51) Int. Cl.

| | |
|---|---|
| ***B65B 57/04*** | (2006.01) |
| ***B65B 19/34*** | (2006.01) |
| ***B65D 85/22*** | (2006.01) |

(58) Field of Classification Search
USPC ..... 53/399, 582, 589; 100/4, 29, 32, 33 PB
See application file for complete search history.

(56) References Cited

U.S. PATENT DOCUMENTS

| | | | | | |
|---|---|---|---|---|---|
| 3,327,618 | A | * | 6/1967 | Cook | B65B 13/02 100/26 |
| 3,447,447 | A | * | 6/1969 | Rutty | B65B 13/06 100/26 |
| 3,667,378 | A | | 6/1972 | Van de Bilt | |
| 4,177,724 | A | * | 12/1979 | Johnson, III | B65B 13/22 100/26 |
| 4,423,584 | A | * | 1/1984 | Elsner | B65B 9/026 53/415 |
| 4,739,605 | A | * | 4/1988 | Takamura | B65B 51/14 53/399 |
| 5,236,329 | A | | 8/1993 | Sylvester | |
| 5,809,873 | A | * | 9/1998 | Chak | B65B 13/22 100/26 |
| 5,836,140 | A | * | 11/1998 | Lancaster, III | B65B 11/025 53/399 |
| 6,748,718 | B2 | * | 6/2004 | Lancaster, III | B65B 11/008 53/399 |
| 6,975,911 | B2 | * | 12/2005 | Stamps | G05B 19/042 100/31 |
| 7,318,308 | B2 | * | 1/2008 | Schmetzer | B65B 13/184 53/389.4 |

FOREIGN PATENT DOCUMENTS

| | | | | |
|---|---|---|---|---|
| EP | 0524134 | A2 | | 1/1993 |
| JP | S5270693 | U | | 5/1977 |
| JP | S58193215 | A | | 11/1983 |
| JP | S62200508 | U | | 12/1987 |
| JP | H04185327 | A | | 7/1992 |
| JP | H0742549 | A | | 2/1995 |
| JP | H1111793 | A | | 1/1999 |
| JP | 2005255359 | A | | 9/2005 |
| JP | 200935307 | A | * | 2/2009 |
| JP | 2009035307 | A | | 2/2009 |
| JP | 2012240728 | A | | 12/2012 |

OTHER PUBLICATIONS

Jul. 8, 2014 International Search Report issued in International Patent Application No. PCT/JP2014/059719.
Dec. 1, 2015 International Preliminary Report on Patentability issued in International Patent Application No. PCT/JP2014/059719.
Jun. 8, 2016 Office Action issued in Chinese Patent Application No. 201480003782.2.
Dec. 30, 2016 Office Action issued in Chinese Patent Application No. 201480003782.2.
Jan. 4, 2017 Search Report issued in European Patent Application No. 14803479.6.
Jun. 12, 2017 Office Action issued in Taiwanese Patent Application No. 103118339.
Jul. 17, 2017 Office Action issued in Chinese Application No. 201480003782.2.
Aug. 1, 2017 Office Action issued in Japanese Patent Application No. 2015-519722.
Nov. 13, 2017 Office Action issued in European Patent Application No. 14 803 479.6.
Mar. 24, 2020 Office Action issued in Korean Application No. 10-2015-7017230.

* cited by examiner

FIG. 5 [PRIOR ART]
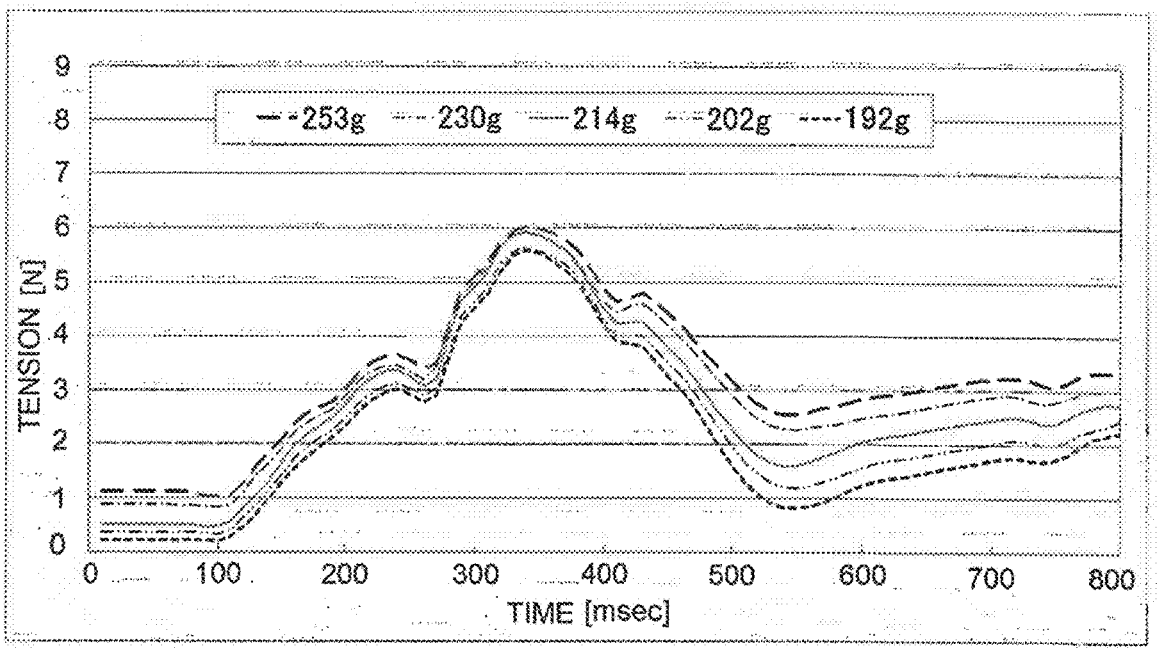
FIG. 6
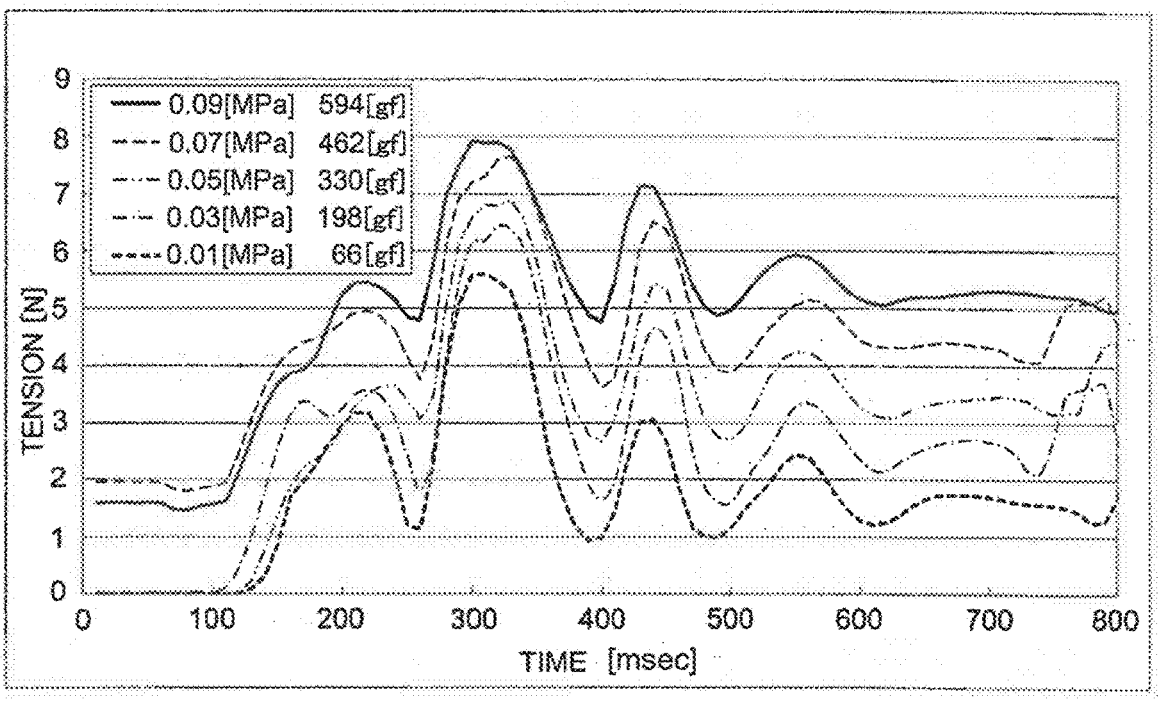

[PRIOR ART]

ROD-SHAPED BODY BINDING DEVICE, BOUND BODY OF ROD-SHAPED BODY, AND ROD-SHAPED BODY BINDING METHOD

TECHNICAL FIELD

The present invention relates to a rod-shaped body binding device which binds rod-shaped bodies (e.g. dried noodles) using a binding tape, a bound body of rod-shaped bodies which have been bound by the rod-shaped body binding device, and a rod-shaped body binding method for binding rod-shaped bodies by the rod-shaped body binding device.

BACKGROUND ART

Dried noodles such as somen noodles and hiyamugi noodles, which are traditionally eaten in Japan, are on sale bound by paper bands. Such dried noodles have coarse surfaces as compared to spaghetti and thus have a large friction resistance among noodles. Generally, when a binding tape with poor elasticity such as paper is used, the tension at the time of binding gives no stretch to the binding tape. This results in no shrinkage of the binding tape at the end of the binding, and thus, the spaces between the noodles do not get smaller. In the case of dried noodles with coarse surfaces such as somen noodles and hiyamugi noodles, friction resistance allows for maintaining the state of being bound even without shrinkage of the binding tape. Meanwhile, since spaghetti have smooth surfaces and thus have a small friction resistance among noodles, there are cases where the state of being bound may not be maintained among spaghetti when a binding tape with poor elasticity is used.

For this reason, there are binding devices dedicated for binding spaghetti by wrapping an elastic binding tape around the spaghetti (see, for example, Patent Literature 1). The bond (tightness) of bound spaghetti which have been bound by such a binding device is determined by how the tension has been applied to the binding tape in a tension regulation mechanism of the binding device. Tension regulation mechanisms of conventional binding devices include a dancer roll and a weight disposed on the opposite side to the dancer roll for a fulcrum. Adjusting the position of the weight allows for regulation of the tension applied to the binding tape during the act of wrapping. Here, the elasticity of the binding tape is utilized for binding bound spaghetti. Binding is carried out while a tension within a certain range is applied to the binding tape to make the binding tape stretch, and when the binding tape returns to its original state at the end of the binding, a firm bond is obtained after shrinkage of the binding tape.

Referring to FIG. 9, a conventional binding device will be described in detail below with an example of a spaghetti binding device. FIG. 9 is a schematic diagram showing a structure from a binding tape supply unit to a binding unit in a conventional spaghetti binding device 100. A binding tape 10 is disposed between a feed roller (drive) 160 and a feed roller (slip stopper) 162, supplied from a binding tape reel 152 according to the motion of the feed roller (drive) 160, redirected as appropriate by guide rolls (112*a*, 121*b*) via a running block 116, and fed to a binding unit 21. The motion of the feed roller (drive) 160 is controlled to repeat an operation and a halt for each binding, and especially when a tension is required, to come to a halt.

The running block 116 is supported by a lever 156 having a fulcrum 154. A weight 158, the position of which may be freely set, is disposed on the opposite side of the fulcrum 154 when seen from the running block 116. The lever 156 is provided so as to be smoothly movable, and is capable of moving freely as shown by an arrow b. A relationship between the running block 116 and the weight 158 is balanced so that the lever 156 usually tilts to the side of the running block 116. The magnitude of a force that acts downward on the running block 116 can be determined by moving the weight 158 in the direction shown by an arrow a. By relocating the weight 158 in the direction away from the fulcrum 154, an adjustment to decrease the force acting downward on the running block 116 can be performed.

In a case where the conventional spaghetti binding device 100 is used, when an operator determines that the tension of the binding tape 10 is insufficient (in excess), the operator is required to halt the spaghetti binding device 100, relocate the weight in the direction closer to (away from) the fulcrum 154, fix the weight thereat, and restart the spaghetti binding device 100.

CITATION LIST

Patent Literature

Patent Literature 1: JP 2009-35307 A.

SUMMARY OF INVENTION

Technical Problem

In conventional binding devices, however, the distance between a tension regulation mechanism and a binding unit is large, and thus a binding tape may stretch with a wide margin. This makes it difficult to properly regulate the tension to be applied to the binding tape. Also, there is no means for determining (measuring) the tension of the binding tape and, naturally, no criteria are defined. Therefore, there may be a large difference in the bond that each operator may consider optimum. When the bond is rather loose, it is prone to a failure in the subsequent devices. Further, there are also problems such as: the effect of regulating the tension to be applied to the binding tape is not easily reflected to the bond since the distance between the tension regulation mechanism and the binding unit is large; and the operating ratio decreases since the binding device has to be halted when regulating the tension to be applied to the binding tape.

An object of the present invention is to provide a rod-shaped body binding device capable of continuously applying an optimum tension to a binding tape that binds rod-shaped bodies, a bound body of rod-shaped bodies having been bound by the rod-shaped body binding device, and a rod-shaped body binding method for binding rod-shaped bodies by the rod-shaped body binding device.

Solution to Problem

A rod-shaped body binding device according to the present invention includes: a binding unit configured to bind a rod-shaped body by wrapping one end section of a binding tape around the rod-shaped body; a stopper configured to stop supply of the binding tape when the rod-shaped body is bound using the binding tape; and a tension regulation unit configured to continuously apply a predetermined tension to the binding tape between the stopper and the binding unit during a period from a beginning to an end of binding of the rod-shaped body by the binding unit.

In the rod-shaped body binding device of the invention, the tension regulation unit includes: a running block disposed between the stopper and the binding unit and configured to guide the binding tape; a cylinder configured to exert, to the running block, a force in the direction of applying a tension to the binding tape; and a tension control unit configured to control an air pressure to be supplied to the cylinder such that the binding tape has a predetermined tension thereof.

The rod-shaped body binding device of the invention further includes: a tension detection unit configured to detect a tension of the binding tape; and a tension control unit configured to regulate a tension to be applied to the binding tape by the tension regulation unit according to a result detected by the tension detection unit.

In the rod-shaped body binding device of the invention, the tension regulation unit includes: a running block disposed between the stopper and the binding unit and configured to guide the binding tape; and a cylinder configured to exert, to the running block, a force in the direction of applying a tension to the binding tape, and the tension control unit controls an air pressure to be supplied to the cylinder according to a result detected by the tension detection unit.

In the rod-shaped body binding device of the invention, the tension regulation unit includes: a tension applying mechanism disposed between the stopper and the binding unit and configured to apply a tension to the binding tape that travels toward the binding unit; and a tension control unit configured to control the tension applying mechanism such that a predetermined tension is applied to the binding tape.

The rod-shaped body binding device of the invention includes: a tension detection unit configured to detect a tension of the binding tape; and a tension control unit configured to regulate a tension to be applied to the binding tape by the tension regulation unit according to a result detected by the tension detection unit.

In the rod-shaped body binding device of the invention, the tension regulation unit includes a tension applying mechanism disposed between the stopper and the binding unit and configured to apply a tension to the binding tape that travels toward the binding unit, and the tension control unit controls the tension applying mechanism such that a predetermined tension is applied to the binding tape according to a result detected by the tension detection unit.

The rod-shaped body binding device of the invention binds the rod-shaped bodies that are dried noodles.

The rod-shaped body binding device of the invention binds the dried noodles that are spaghetti.

A bound body of a rod-shaped body of the invention has been bound by the rod-shaped body binding device of the invention.

A rod-shaped body binding method of the invention includes: a binding tape supplying step of supplying the binding tape from a binding tape supply unit to the binding unit; and a rod-shaped body binding step of binding the rod-shaped body by the binding tape in the binding unit, wherein, in the rod-shaped body binding step, supply of the binding tape is halted by a stopper while a tension regulation unit applies a certain tension to the binding tape between the stopper and the binding unit during a period from a beginning to an end of binding of the rod-shaped body.

In the rod-shaped body binding method of the invention, the rod-shaped body binding step includes a tension detection step of detecting a tension of the binding tape between the stopper and the binding unit by a tension detection unit, and in the rod-shaped body binding step, the certain tension applied by the tension regulation unit is regulated according to a result detected in the tension detection step.

Advantageous Effects of Invention

The present invention provides a rod-shaped body binding device capable of continuously applying an optimum tension to a binding tape for binding rod-shaped bodies, a bound body of rod-shaped bodies which have been bound by the rod-shaped body binding device, and a method therefor.

BRIEF DESCRIPTION OF DRAWINGS

FIG. 5 is a diagram showing the tension of a binding tape during the act of binding by a conventional spaghetti binding device.

FIG. 6 is a diagram showing the tension of a binding tape during the act of binding by the spaghetti binding device according to the invention.

DESCRIPTION OF EMBODIMENTS

Figure 1:
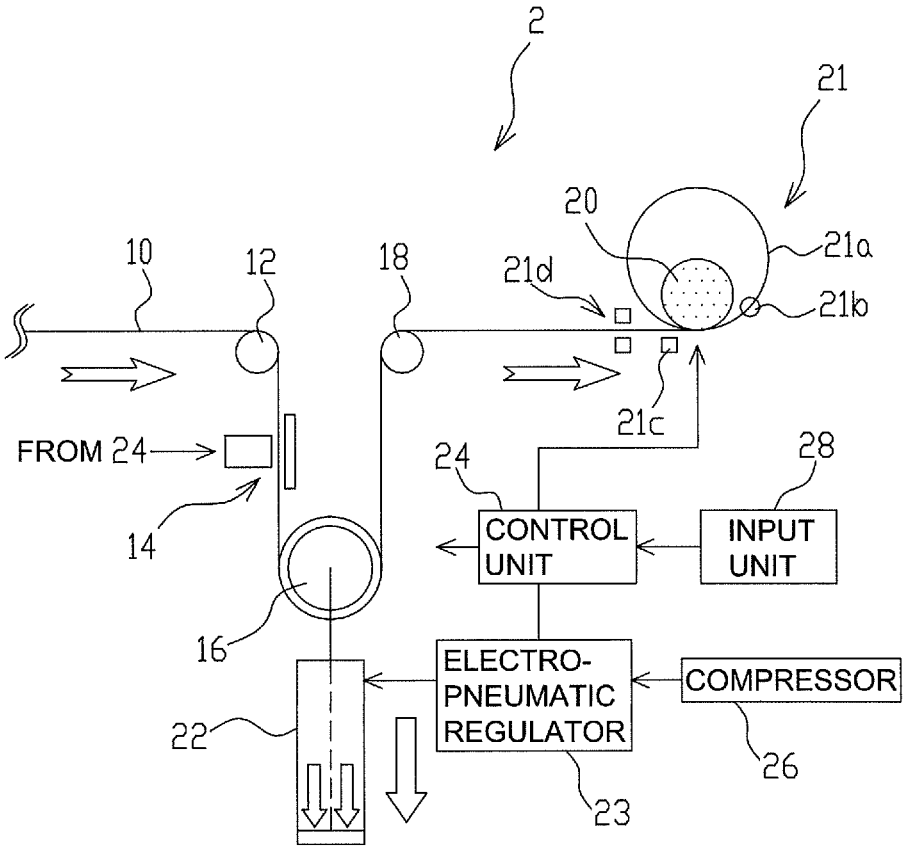
FIG. 1 is a schematic diagram showing a structure from a stopper to a binding unit in a spaghetti binding device according to a first embodiment.

Spaghetti binding devices serving as rod-shaped body binding devices according to embodiments of the invention will be described below with reference to the drawings. FIG. 1 is a schematic diagram showing a structure from a stopper 14 to a binding unit 21 in a spaghetti binding device 2 according to a first embodiment. A plastic binding tape 10 fed from a feed roll (not shown) travels in the horizontal direction until a guide roll changes the traveling direction thereof to downward. The binding tape 10 traveling downward is fed to a running block 16 via the stopper 14, and then the traveling direction is changed to upward by the running block 16. A guide roll 18 further changes the traveling direction to a horizontal direction, thereby leading the binding tape 10 to the binding unit 21, where spaghetti 20 are bound.

The binding unit 21 includes a rotary guide unit 21*a*, a tape clamping unit 21*b*, a welding and fusing unit 21*c*, and a tape holding unit 21*d*. The rotary guide unit 21*a* has a round opening and positions spaghetti. The tape clamping unit 21*b* is included in the rotary guide unit 21*a*. The welding and fusing unit 21*c* welds and fuses the binding tape 10. The tape holding unit 21*d* is provided in the proximity of the rotary guide unit 21*a*.

The running block 16 is coupled to a low-friction cylinder 22. The low-friction cylinder 22 is connected to an electro-pneumatic regulator 23, which receives, from a control unit 24, a pressure control signal that corresponds to a setting pressure set in the control unit 24 and executes pressure control so that the pressure of the gas supplied from a compressor 26 equals the setting pressure. Here, the setting pressure may be set by a user via an input unit 28. The control unit 24 further controls the stopper 14 and the binding unit 21. Note that, in this embodiment, the running block 16, the low-friction cylinder 22, the electro-pneumatic regulator 23, and the control unit 24 constitute a tension regulation unit.

For the spaghetti binding device 2 of the embodiment, a hopper (not shown) for storing spaghetti 20 is provided above the binding unit 21. The spaghetti 20 having been supplied from the hopper are weighed by a weighing device (not shown), and the spaghetti 20 of a predetermined quantity fall onto the binding unit 21. The spaghetti 20 of a predetermined quantity are further positioned in the rotary guide unit 21*a* in the binding unit 21. A tip of the binding tape 10 is clamped by the tape clamping unit 21*b*, and the tape holding unit 21*d* then releases the binding tape 10 while the stopper 14 holds the binding tape 10, thereby stopping the supply of the binding tape 10 toward the binding unit 21. In the above configuration, the rotary guide unit 21*a* makes two rotations, thereby wrapping the binding tape 10 around the tips of the spaghetti 20 for two rounds.

Here, during the period from the beginning to the end of binding of the spaghetti 20 by the binding unit 21, the running block 16 continuously receives a predetermined downward force since the electro-pneumatic regulator 23 regulates the pressure of the gas supplied from the compressor 26 to the low-friction cylinder 22 to achieve the pressure having been set. Thus, during the period from the beginning to the end of binding of the spaghetti 20, the binding tape 10 between the stopper 14 and the binding unit 21 continuously receives a predetermined tension applied by the tension regulation unit. Note that, for the relationship between the pressure of the gas supplied from the compressor 26 to the low-friction cylinder 22 by the electro-pneumatic regulator 23 and the tension applied to the binding tape 10, a value that has been obtained in advance to achieve an optimum bond of the spaghetti 20 is used.

Thereafter, the tape holding unit 21*d* holds the binding tape 10, and the welding and fusing unit 21*c* welds and fuses the binding tape 10. In this manner, one cycle of binding of the spaghetti 20 is completed. In this case, the predetermined tension is applied to the binding tape 10 that has bound the spaghetti 20, upon binding the spaghetti 20. Therefore, binding of the spaghetti 20 is carried out while the binding tape 10 is elongated. After the binding, the binding tape 10 is fused and the binding tape 10 shrinks. This allows for binding the spaghetti 20, having smooth surfaces, in a preferable manner. Then the stopper 14 releases the binding tape 10, and the binding tape 10 required for one cycle of binding is fed to the side of the tension regulation unit. By repeating these actions, continuous binding of the spaghetti 20 is achieved.

In the spaghetti binding device 2 of the first embodiment, the tension regulation unit and the binding unit 21 are disposed in close proximity, thereby making the stretching margin of the binding tape 10 smaller. This allows for controlling the tension of the binding tape 10 to be optimum. Also, by arbitrarily regulating, by the electro-pneumatic regulator 23, the supplying pressure to the low-friction cylinder 22 coupled to the running block 16, the tension applied to the binding tape 10 may arbitrarily be regulated. Furthermore, in the spaghetti binding device 2, regulation of the tension to be applied to the binding tape 10 can be carried out without halting the spaghetti binding device 2. This allows the regulation to be made while confirming binding results, thus making the regulation easier to carry out. This also prevents the operating ratio of the spaghetti binding device 2 from decreasing.

Figure 2:
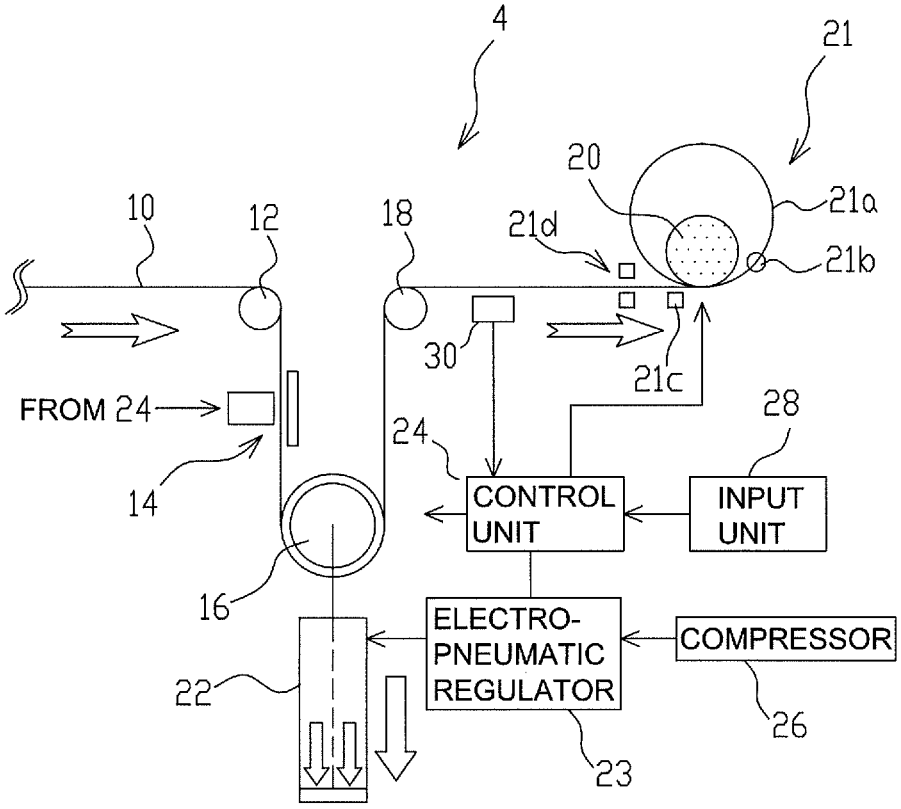
FIG. 2 is a schematic diagram showing a structure from a stopper to a binding unit in a spaghetti binding device according to a second embodiment.

A spaghetti binding device 4 according to a second embodiment will be described next with reference to FIG. 2. The spaghetti binding device 4 according to the second embodiment further includes, in addition to the spaghetti binding device 2 of the first embodiment, a tension detection unit 30 which detects the tension of a binding tape 10. The spaghetti binding device 4 regulates the tension to be applied to the binding tape 10 according to a result detected by the tension detection unit 30. Therefore, in the description of the second embodiment, the same numerals are used as in the description of the first embodiment for describing the same structure as the structure in the spaghetti binding device 2 of the first embodiment. Also, the same descriptions as in the spaghetti binding device 2 of the first embodiment are omitted and different parts are described in detail.

The spaghetti binding device 4 of the second embodiment includes the tension detection unit 30 disposed between a guide roll 18 and a binding unit 21. The tension detection unit 30 detects the tension of the binding tape 10. The tension of the binding tape 10 detected by the tension detection unit 30 is input to a control unit 24. Thus, in the spaghetti binding device 4, during the period from the beginning to the end of binding of spaghetti 20, the control unit 24 determines whether the tension detected by the tension detection unit 30 is equal to a tension having been set. When it is determined that there is a difference, the control unit 24 controls an electro-pneumatic regulator 23 to regulate the tension applied to the binding tape 10 to be equal to the tension having been set.

In the spaghetti binding device 4 of the second embodiment, during the period from the beginning to the end of binding of the spaghetti 20, by means of feedback control using the tension detected by the tension detection unit 30, the tension to be applied to the binding tape 10 can be regulated to be equal to the tension having been set. Therefore, the spaghetti 20 having smooth surfaces can be bound in a preferable manner.

Figure 3:
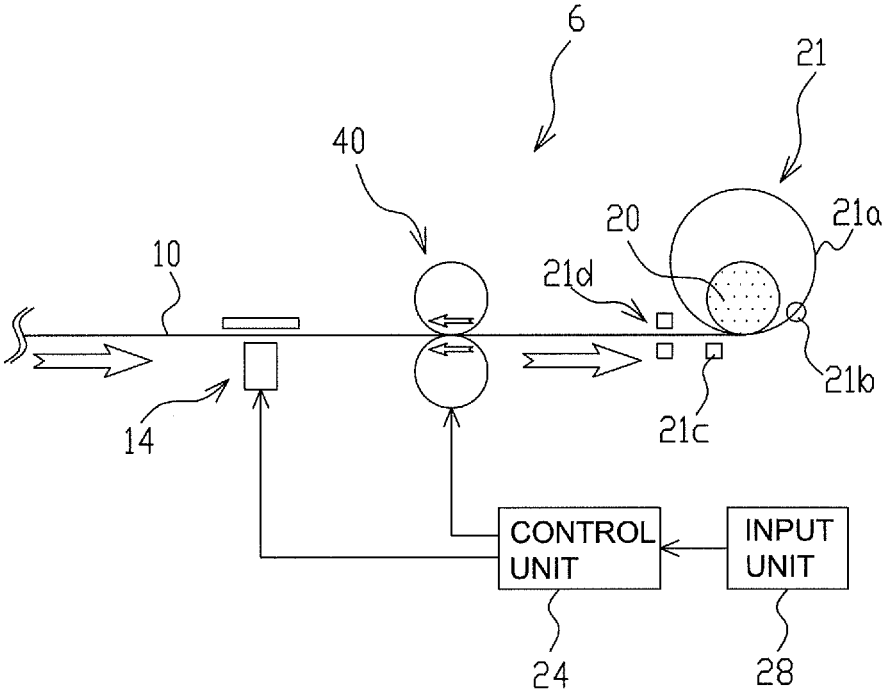
FIG. 3 is a schematic diagram showing a structure from a stopper to a binding unit in a spaghetti binding device according to a third embodiment.

A spaghetti binding device 6 according to a third embodiment will be described next with reference to FIG. 3. The spaghetti binding device 6 according to the third embodiment includes a tension regulation unit with a modification to the tension regulation unit in the spaghetti binding device 2 of the first embodiment, i.e., with a speed control mechanism therein. Therefore, in the description of the third embodiment, the same numerals are used as in the description of the first embodiment for describing the same structure as the structure in the spaghetti binding device 2 of the first embodiment. Also, the same descriptions as in the spaghetti binding device 2 of the first embodiment are omitted and different parts are described in detail.

The spaghetti binding device 6 of the third embodiment includes a tension applying mechanism 40 disposed between a stopper 14 and a binding unit 21. The tension applying mechanism 40 controls the tension of a binding tape 10 that travels toward the binding unit 21. Here, the tension applying mechanism 40 has a mechanism which controls the rotation and/or the torque of a brake roll or a guide roll by a servomotor. The tension applying mechanism 40, according to the control by a control unit 24, controls the tension so that a substantially constant and predetermined tension will be applied to the binding tape 10. Therefore, during the period from the beginning to the end of binding of spaghetti 20, the control unit 24 controls the tension applying mechanism 40 so that the tension of the binding tape 10 equals a tension having been set at the control unit 24, thereby continuously applying the predetermined tension to the binding tape 10. This allows for binding the spaghetti 20 having smooth surfaces in a preferable manner.

Figure 4:
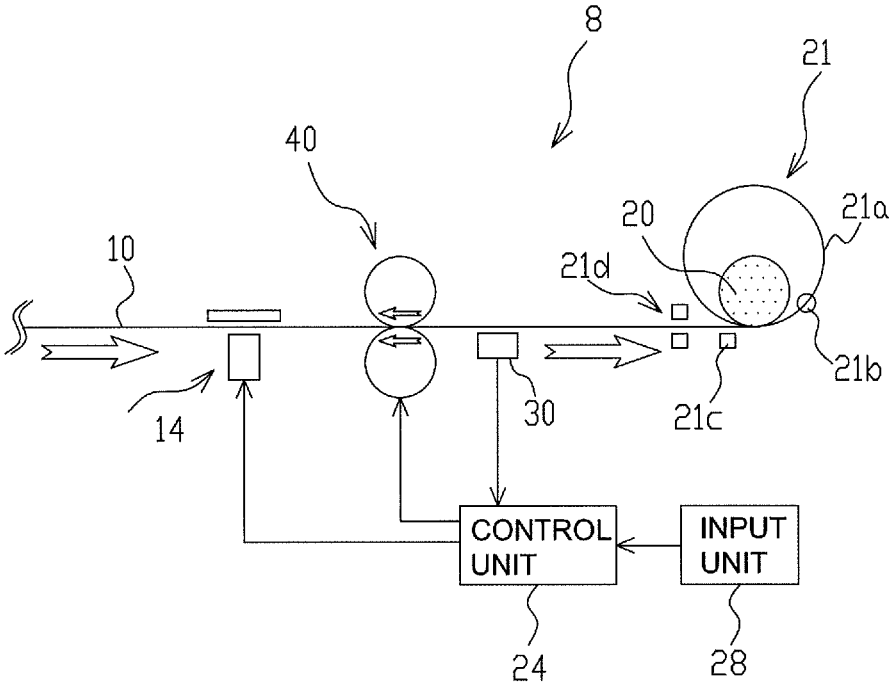
FIG. 4 is a schematic diagram showing a structure from a stopper to a binding unit in a spaghetti binding device according to a fourth embodiment.

A spaghetti binding device 8 according to a fourth embodiment will be described next with reference to FIG. 4. The spaghetti binding device 8 of the fourth embodiment further includes, in addition to the spaghetti binding device 6 of the third embodiment, a tension detection unit 30 which detects the tension of a binding tape 10. The spaghetti binding device 8 regulates the tension to be applied to the binding tape 10 according to a result detected by the tension detection unit 30. Therefore, in the description of the fourth embodiment, the same numerals are used as in the description of the third embodiment for describing the same structure as the structure in the spaghetti binding device 6 of the third embodiment. Also, the same descriptions as in the spaghetti binding device 6 of the third embodiment are omitted and different parts are described in detail.

The spaghetti binding device 8 of the fourth embodiment includes the tension detection unit 30, which detects the tension of the binding tape 10, disposed between a stopper 14 and a binding unit 21. The tension of the binding tape 10 detected by the tension detection unit 30 is input to a control unit 24. Thus, in the spaghetti binding device 8, during the period from the beginning to the end of binding of spaghetti 20, the control unit determines whether the tension detected by the tension detection unit 30 is equal to a tension having been set. When it is determined that there is a difference, the control unit 24 controls the tension applying mechanism 40 to regulate the tension applied to the binding tape 10 to be equal to the tension having been set.

In the spaghetti binding device 8 of the fourth embodiment, during the period from the beginning to the end of binding of the spaghetti 20, by means of feedback control using the tension detected by the tension detection unit 30, the tension applied to the binding tape 10 can be regulated to be equal to the tension having been set. Therefore, the spaghetti 20 having smooth surfaces can be bound in a preferable manner.

FIG. 5 is a diagram showing the tension of a binding tape upon binding by a conventional spaghetti binding device, while FIG. 6 is a diagram showing the tension of a binding tape upon binding by the spaghetti binding device according to the invention. Forces shown in the legend of FIG. 5 denote measured values of forces acting downward on the running block 116. Pressures shown in the legend of FIG. 6 denote air pressures supplied by the electro-pneumatic regulator 23 to the low-friction cylinder 22. Measured values of forces acting downward are also shown for each pressure. In the conventional spaghetti binding device, even when the weight is relocated with a maximum difference in distance for changing the tension of the binding tape, the differences in the tension of the binding tape are small. Also with the actual finish of bound spaghetti, the bond by the binding tape has not been controlled remarkably. In the spaghetti binding device of the invention, in contrast, locating a tension regulation mechanism closer to a binding unit has allowed for not only an increase of an absolute value of the tension of the binding tape but also a larger difference in the tension under each regulation condition.

Figure 7:
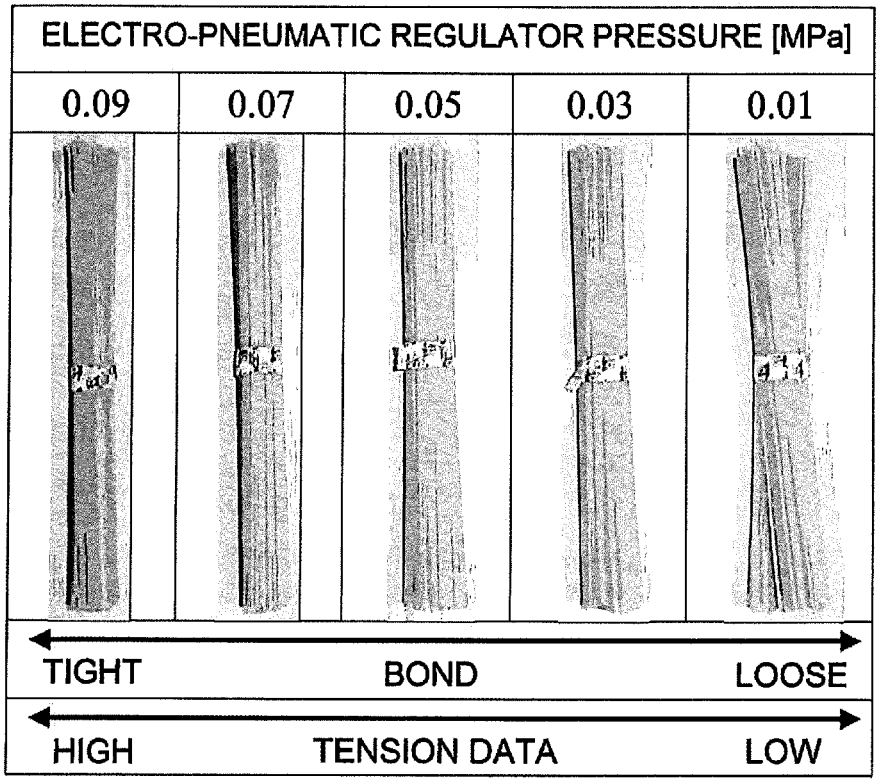
FIG. 7 is a diagram showing the bond of bound spaghetti which have been bound by the spaghetti binding device according to the invention.

FIG. 7 is a diagram showing the bond of bound spaghetti having been bound by the spaghetti binding device of the invention. Regarding the cylinder pressure in a low-friction cylinder, the tension of a binding tape upon binding, and the bond of the bound spaghetti, the following correlations were confirmed.

(i) When the cylinder pressure is low: the tension is low and the bond is loose.

(ii) When the cylinder pressure is high: the tension is high and the bond is tight.

As stated above, visualization of the bond of bound spaghetti, which conventionally has been a problem, is now achieved.

Figure 8:
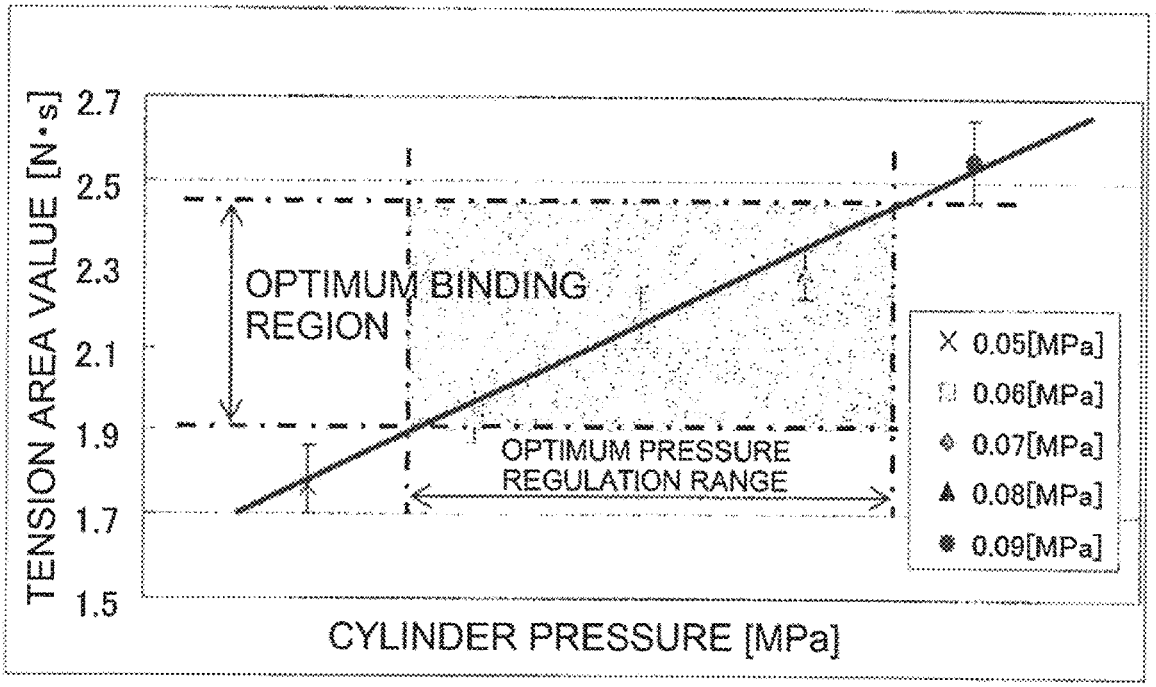
FIG. 8 is a diagram showing the relationship between area values of the tension measured in the binding tape and cylinder pressures.
Figure 9:
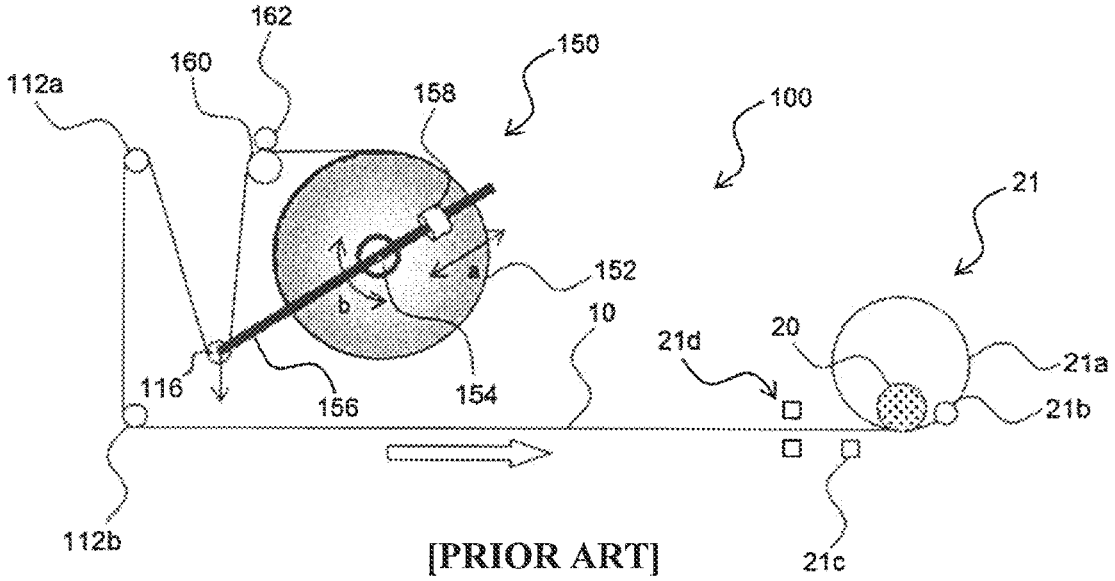
FIG. 9 is a schematic diagram showing a structure from a binding tape supply unit to a binding unit in a conventional spaghetti binding device.

FIG. 8 is a diagram showing a relationship between area values of measured tensions of the binding tape and cylinder pressures. Tension area values were calculated from areas in the range of 200 to 700 msec as shown in FIG. 6. For the shaded area shown in FIG. 8, all bound products were actually checked and confirmed to be in the optimum bond. This shows that the bond can be evaluated by checking the tension at the time of binding. As above, it is confirmed that usage of a tension value allows for evaluation of the bond and, when an unfavorable difference occurs, a feedback control may be carried out.

Note that, although examples of binding devices for binding spaghetti have been described in the above-described embodiments as rod-shaped body binding devices, the present invention may also be applied to binding devices for binding dried noodles such as somen noodles and udon noodles.

The invention claimed is:

1. A rod-shaped body binding device comprising:

a binding unit configured to bind a rod-shaped body by:
- clamping one end section of a binding tape,
- wrapping the binding tape for a plurality of revolutions around the rod-shaped body after clamping the one end section of the binding tape, and
- welding the wrapped binding tape;

a stopper configured to stop a supply of the binding tape and hold the binding tape during a time period (i) staring at a time when the binding unit clamps the one end section of the binding tape, (ii) during which the binding unit wraps the binding tape for a plurality of revolutions around the rod-shaped body by stretching the binding tape and wrapping the rod-shaped body with the stretched binding tape, and (iii) ending at a time when the binding unit welds the binding tape, such that a binding tape section between the stopper and the one end section of the binding tape is stretched during the time period; and a tension regulator configured to maintain a fixed tension to the binding tape section as the binding tape section is stretched during the time period, the tension regulator including:
- a running block disposed between the stopper and the binding unit, the running block being configured to guide the binding tape,
- a cylinder configured to exert a force on the running block in a direction opposite to a direction of a force exerted by the binding tape on the running block, and
- a tension control unit configured to control an air pressure supplied to the cylinder such that the binding tape maintains the fixed tension.

2. The rod-shaped body binding device of claim 1, wherein the tension control unit is configured to regulate the fixed tension applied to the binding tape by the tension regulator according to a detected tension of the binding tape.

3. The rod-shaped body binding device of claim 1, wherein the rod-shaped body is dried noodles.

4. The rod-shaped body binding device of claim 3, wherein the dried noodles are spaghetti.

5. A bound body of the rod-shaped body which has been bound by the rod-shaped body binding device of claim 1.

6. A rod-shaped body binding method for binding a rod-shaped body in a binding unit by wrapping a binding tape to which a fixed tension is continuously applied around the rod-shaped body, the method comprising:

a binding tape supplying step of supplying the binding tape from a binding tape supply unit to the binding unit;

a clamping step of clamping a first end section of the binding tape in the binding unit;

a stopping step of stopping the supply of the binding tape and holding the binding tape by a stopper during a time period (i) starting at a time of the clamping step, (ii) during a wrapping step of wrapping the binding tape around the rod-shaped body for a plurality of revolutions, and (iii) ending at a time of a welding step of welding the binding tape wrapped around the rod-shaped body in the binding unit such that a binding tape section between the stopper and the first end section of the binding tape is elongated during the time period; and a tension regulating step of maintaining the fixed tension to the binding tape section as the binding tape section is elongated during the time period, wherein the tension regulating step regulates the tension of the binding tape using:

a running block disposed between the stopper and the binding unit and configured to guide the binding tape, a cylinder configured to exert a force to the running block in a direction opposite to a direction of a force exerted by the binding tape to the running block, and a tension control unit configured to control an air pressure supplied to the cylinder such that the binding tape maintains the fixed tension.

7. The rod-shaped body binding method of claim 6, wherein:

the tension regulating step includes a tension detection step of detecting a tension of the binding tape between the stopper and the binding unit, and in the tension regulating step, the fixed tension is regulated according to the detected tension in the tension detection step.

8. A rod-shaped body binding device comprising:

a binding unit configured to bind a rod-shaped body by:

clamping one end section of a binding tape, wrapping the binding tape for a plurality of revolutions around the rod-shaped body after clamping the one end section of the binding tape, and welding the wrapped binding tape;

a stopper configured to stop a supply of the binding tape and hold the binding tape during a time period (i) starting at a time when the binding unit clamps the one end section of the binding tape, (ii) during which the binding unit wraps the binding tape for a plurality of revolutions around the rod-shaped body by stretching the binding tape and wrapping the rod-shaped body with the stretched binding tape, and (iii) ending at a time when the binding unit welds the binding tape, such that a binding tape section between the stopper and the end section of the binding tape is stretched during the time period; and a tension regulator configured to maintain a fixed tension to the binding tape section as the binding tape section is stretched during the time period, the tension regulator including a tension control unit.

9. The rod-shaped body binding device of claim 8, wherein the tension regulator includes a tension applying mechanism configured to control a rotation or a torque of a brake roll with a servomotor and apply the fixed tension to the binding tape that travels toward the binding unit, the tension applying mechanism being disposed between the stopper and the binding unit.

10. The rod-shaped body binding device of claim 8, wherein:

the tension regulator includes a tension applying mechanism configured to control a rotation or torque of a brake roll with a servomotor and apply the fixed tension to the binding tape that travels toward the binding unit, the tension applying mechanism being disposed between the stopper and the binding unit, and the tension control unit is configured to control the tension applying mechanism such that the fixed tension is applied to the binding tape according to the detected tension.

* * * * *